US009933733B2

(12) United States Patent
Kamiya

(10) Patent No.: US 9,933,733 B2
(45) Date of Patent: Apr. 3, 2018

(54) FIXING DEVICE AND IMAGE FORMING APPARATUS HAVING A SWITCHING PORTION

(71) Applicant: FUJI XEROX CO., LTD., Tokyo (JP)

(72) Inventor: Shogo Kamiya, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/245,610

(22) Filed: Aug. 24, 2016

(65) Prior Publication Data

US 2017/0219971 A1 Aug. 3, 2017

(30) Foreign Application Priority Data

Feb. 1, 2016 (JP) ..... 2016-017230

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

FOREIGN PATENT DOCUMENTS

JP 2006-126536 A 5/2006
JP 2009-163188 A 7/2009

*Primary Examiner* — Quana M Grainger
(74) *Attorney, Agent, or Firm* — Oliff PLC

(57) ABSTRACT

A fixing device includes a first support portion that supports an endless belt, and relatively moves with respect to a rotating body to press the endless belt against the rotating body, a second support portion that supports the first support portion to be relatively movable, a first member that is supported in the endless belt by the second support portion, a second member that is supported in the endless belt to be capable of approaching and being separated from the first support portion, a first biasing member that is provided in the first support portion, and biases the second member to a rotating body side, a second biasing member that is provided in the second support portion, and biases the first support portion to the rotating body side, and a switching portion that switches between a first state and a second state.

12 Claims, 17 Drawing Sheets

FIXING DEVICE AND IMAGE FORMING APPARATUS HAVING A SWITCHING PORTION

CROSS-REFERENCE TO RELATED APPLICATIONS

This application is based on and claims priority under 35 USC 119 from Japanese Patent Application No. 2016-017230 filed Feb. 1, 2016.

BACKGROUND

Technical Field

The present invention relates to a fixing device and an image forming apparatus.

SUMMARY

According to an aspect of the invention, a fixing device includes a first support portion that supports an endless belt, and relatively moves with respect to a rotating body to press the endless belt against the rotating body, a second support portion that supports the first support portion to be relatively movable, a first member that is supported in the endless belt by the second support portion, a second member that is supported in the endless belt to be capable of approaching and being separated from the first support portion, a first biasing member that is provided in the first support portion, and biases the second member to a rotating body side, a second biasing member that is provided in the second support portion, and biases the first support portion to the rotating body side, and a switching portion that switches between a first state and a second state. In the first state, the endless belt is pressed against the rotating body by the first member and the second member by moving the second support portion in a direction of approaching the rotating body. In the second state, the endless belt is pressed against the rotating body only by the second member among the first member and the second member by moving the second support portion in a direction of being separated from the rotating body.

BRIEF DESCRIPTION OF THE DRAWINGS

Exemplary embodiments of the present invention will be described in detail based on the following figures, wherein:

FIG. 7 is a sectional view taken through a different part from the part through which FIG. 5 is taken and illustrates the parent lever and the block member in a first state illustrated in FIG. 5;

FIG. 10 is a sectional view taken through a different part from the part through which FIG. 8 is taken and illustrates the parent lever and the block member in a second state illustrated in FIG. 8;

FIG. 12 is a sectional view taken through a different part from the part through which FIG. 11 is taken and illustrates the parent lever and the block member in a latch release state illustrated in FIG. 11;

DETAILED DESCRIPTION

Figure 1:
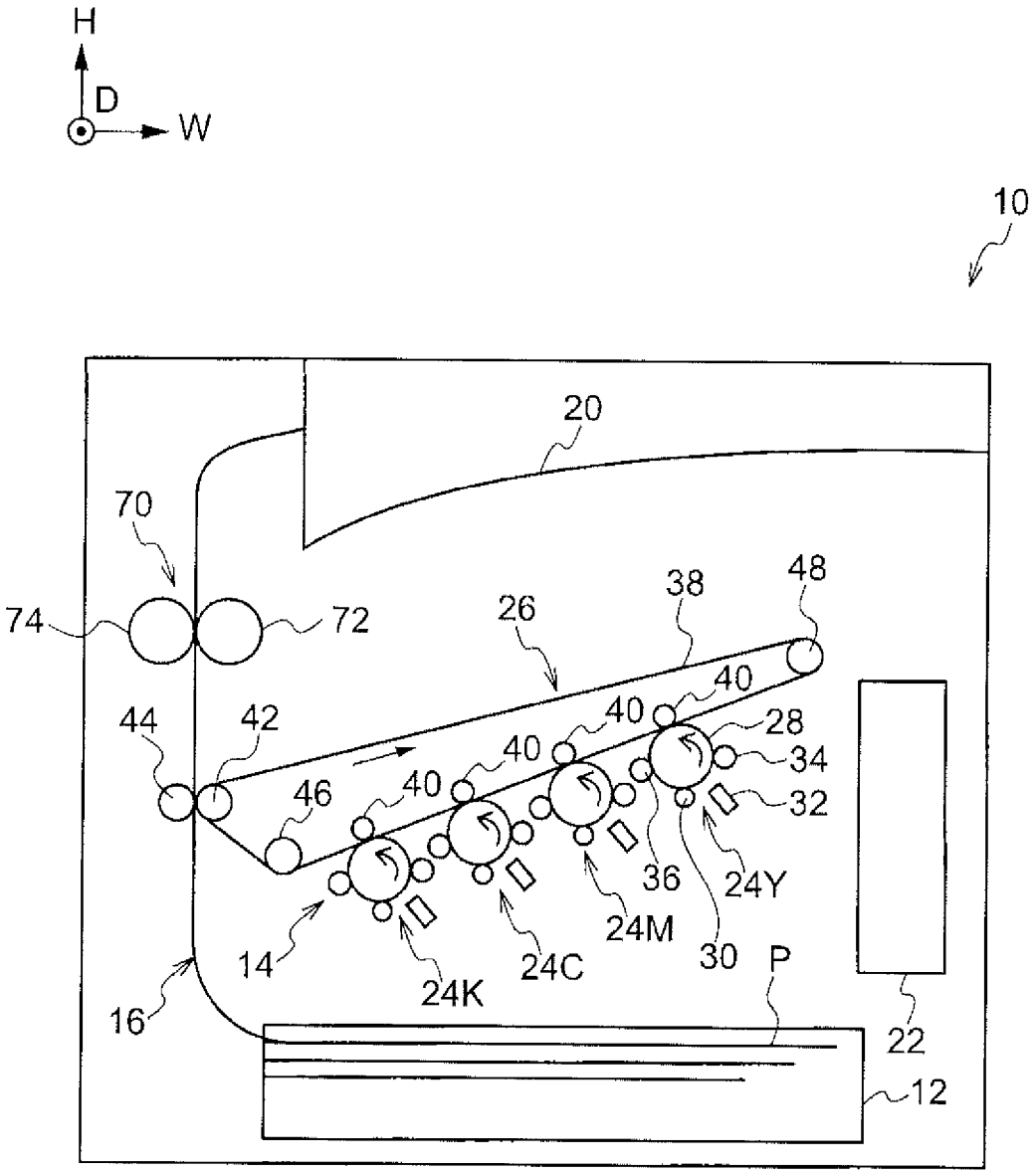
FIG. 1 is a configuration view illustrating an image forming apparatus according to an exemplary embodiment of the invention.

Hereinafter, exemplary embodiments of a fixing device and an image forming apparatus of the invention will be described based on the drawings. In addition, in the drawings, the direction illustrated by an arrow H is the apparatus height direction, and the direction illustrated by an arrow W is the apparatus width direction. In the drawings, the direction which is illustrated by an arrow D which is orthogonal to each of the apparatus height direction and the apparatus width direction, is the apparatus depth direction (arrow D indicates a near side in the apparatus depth direction).

Entire Configuration of Image Forming Apparatus

In FIG. 1, an example of a configuration of the image forming apparatus provided with the fixing device according to a first exemplary embodiment of the invention is described. As illustrated in FIG. 1, an image forming apparatus 10 includes a recording paper accommodating unit 12 which accommodates a recording paper P which is an example of a recording medium, a toner image forming unit 14, a transport unit 16, a fixing device 70, an output unit 20, and a controller 22. The toner image forming unit 14 is provided with four image forming units 24Y, 24M, 24C, and 24K, and a transfer unit 26. Here, yellow (Y), magenta (M), cyan (C), and black (K) are examples of toner colors. Each of the image forming units 24Y, 24M, 24C, and 24K is provided with a photoconductor 28, a charging device 30, an exposure device 32, a developing device 34, and a removing device 36. In each of the image forming units 24Y, 24M, 24C, and 24K, toner images of each color of yellow (Y), magenta (M), cyan (C), and black (K) are formed on an outer circumferential surface of each photoconductor 28.

The photoconductor 28 has a function of holding the toner image developed by the developing device 34. The photoconductor 28 is formed in a cylindrical shape, is provide with a photoconductive layer on a surface thereof, and is driven to rotate in the arrow direction by a driving unit (not illustrated). The developing device 34 develops a latent image formed in the photoconductor 28 as the toner image.

The transfer unit 26 is provided with a transfer belt 38, a primary transfer roll 40 of each color, a driving roll 42, and a secondary transfer roll 44. A posture of the transfer belt 38 is determined by four rolls, including the primary transfer roll 40, a support roll 46, the driving roll 42, and a tension applying roll 48, which are in contact with the inner circumferential surface. In the transfer belt 38, a cleaning device which is not illustrated is provided on the downstream side of a secondary transfer portion which is in contact with the secondary transfer roll 44. The outer circumferential surface of each photoconductor 28 disposed in each of the image forming units 24Y, 24M, 24C, and 24K, is in contact with the outer circumferential surface on the lower side of the transfer belt 38.

The transport unit 16 is provided with a sending roll which is not illustrated and sends out the recording paper P from the recording paper accommodating unit 12, and plural transporting roll pairs which are not illustrated along a transporting path, and transports the recording paper P sent out by the sending roll to the secondary transfer portion which is at a position at which the driving roll 42 and the secondary transfer roll 44 oppose each other. Furthermore, the transport unit 16 transports the recording paper P to the fixing device 70. In the fixing device 70, the toner image which is secondarily transferred to the recording paper P is fixed to the recording paper P, and further, the recording paper P is transported to the output unit 20 by the transport unit 16.

In the image forming apparatus 10, exposure light emitted in accordance with image data of each color from the exposure device 32 is incident on the outer circumferential surface of the photoconductor 28 charged by the charging device 30, and the latent image which corresponds to the image data of each color is formed on the outer circumferential surface of each photoconductor 28. The latent image formed on the outer circumferential surface of each photoconductor 28 is developed as the toner image of each color by each developing device 34. The toner image of each color of the outer circumferential surface of each photoconductor 28 is primarily transferred to the outer circumferential surface of the transfer belt 38 by each primary transfer roll 40 which opposes each photoconductor 28.

Meanwhile, in accordance with a timing at which the toner image of each color which is primarily transferred to the transfer belt 38 reaches the secondary transfer portion, the recording paper P is sent out of the recording paper accommodating unit 12, and is transported to the secondary transfer portion provided with the secondary transfer roll 44. In the secondary transfer portion, the toner image of each color on the transfer belt 38 is secondarily transferred to the recording paper P. Furthermore, after the recording paper P to which the toner image is transferred is transported toward the fixing device 70, is heated in a contact portion between a heating roll 72 and a fixing belt 74 which will be described later, and is pressurized, and the toner image is fixed to the recording paper P, the recording paper P is output to an output unit 20.

Configuration of Fixing Device

Figure 2:
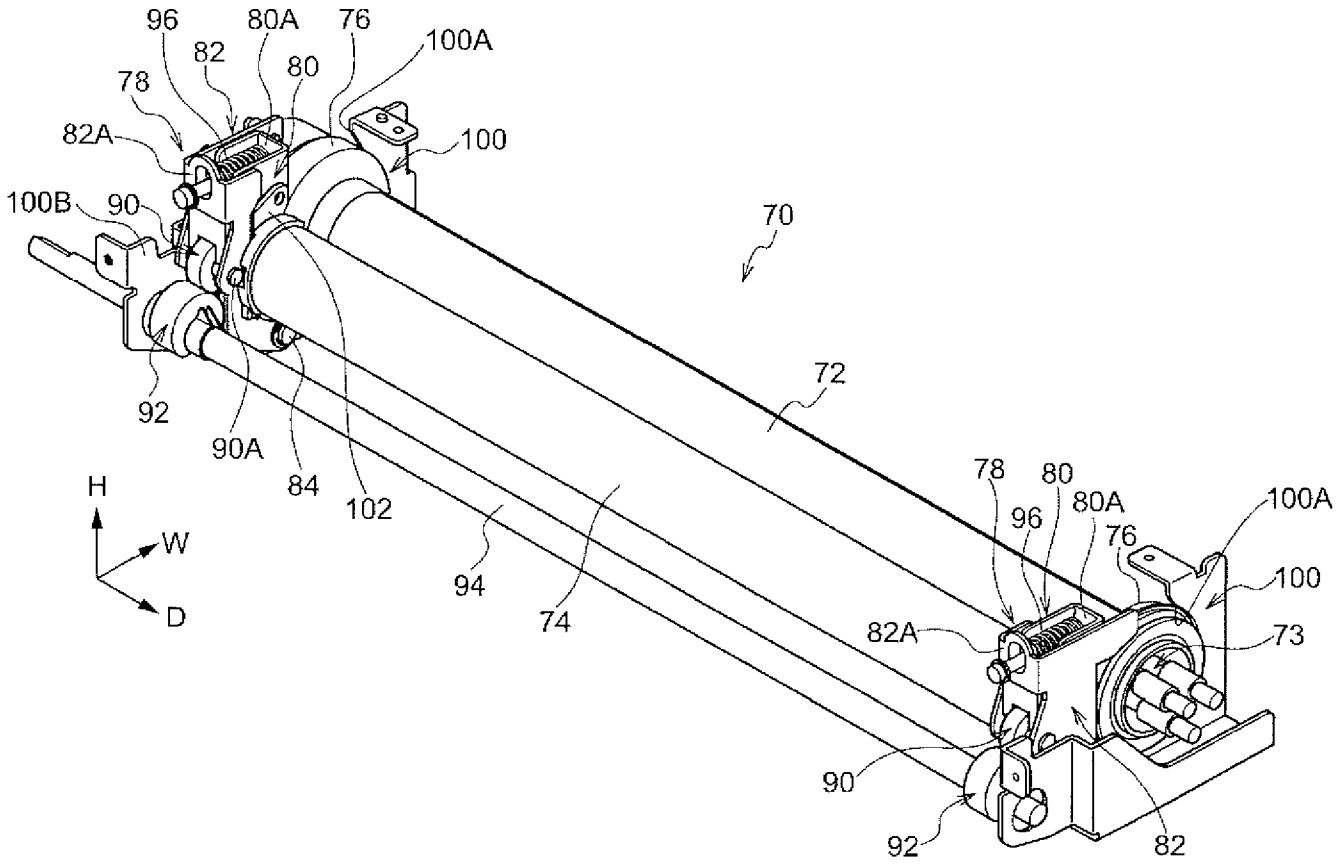
FIG. 2 is a perspective view illustrating a fixing device according to a first exemplary embodiment which is used in the image forming apparatus illustrated in FIG. 1.
Figure 3:
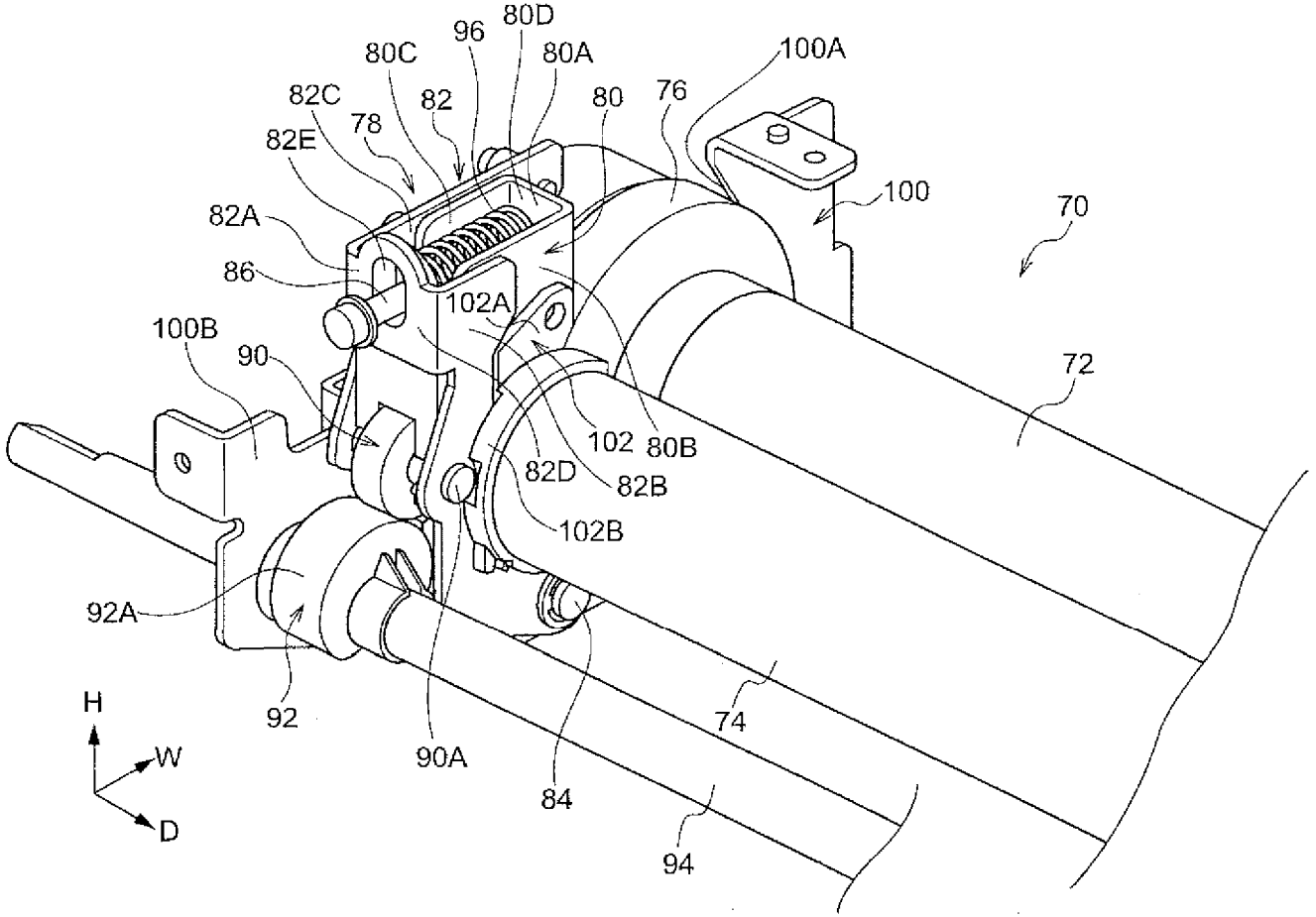
FIG. 3 is a perspective view illustrating one end portion in the shaft direction of a fixing belt and a heating roll which are used in the fixing device illustrated in FIG. 2.

Next, the fixing device 70 will be described. In FIG. 2, the fixing device 70 is illustrated in a perspective view, and in FIG. 3, a state where one end portion side of the fixing device 70 in the longitudinal direction is illustrated in a perspective view. As illustrated in FIGS. 2 and 3, the fixing device 70 is provided with the heating roll 72 which is an example of a rotating body, and the fixing belt 74 which is an example of an endless belt that is in contact with or is separated from the heating roll 72. The heating roll 72 and the fixing belt 74 are aligned in the apparatus width direction illustrated by the arrow W.

The fixing device 70 is provided with a support member 76 and a support unit 78. The support member 76 supports both end portions of the heating roll 72 to be rotatable. The support unit 78 supports both end portions of the fixing belt 74 to be rotatable, and relatively moves with respect to the support member 76 to presses the fixing belt 74 against the heating roll 72. The support members 76 are provided in both end portions of the heating roll 72 as a left and right pair, and the support units 78 are provided in both end portions of the fixing belt 74 as a left and right pair (refer to FIG. 2). The heating roll 72 and the fixing belt 74 are disposed considering the apparatus depth direction illustrated by the arrow D of the image forming apparatus 10 as the shaft direction (longitudinal direction).

The heating roll 72 has a multilayer structure provided with a thin cylindrical core bar made of a steel material, an elastic layer made of silicone rubber with which the surface of the core bar is coated, and a release layer including a fluororesin with which the surface of the elastic layer is coated. On the inside of the heating roll 72, a heat source 73 configured with plural halogen lamps (three in the exemplary embodiment) is disposed at an interval with the inner circumferential surface of the heating roll 72 (refer to FIGS. 2 and 5).

Figure 5:
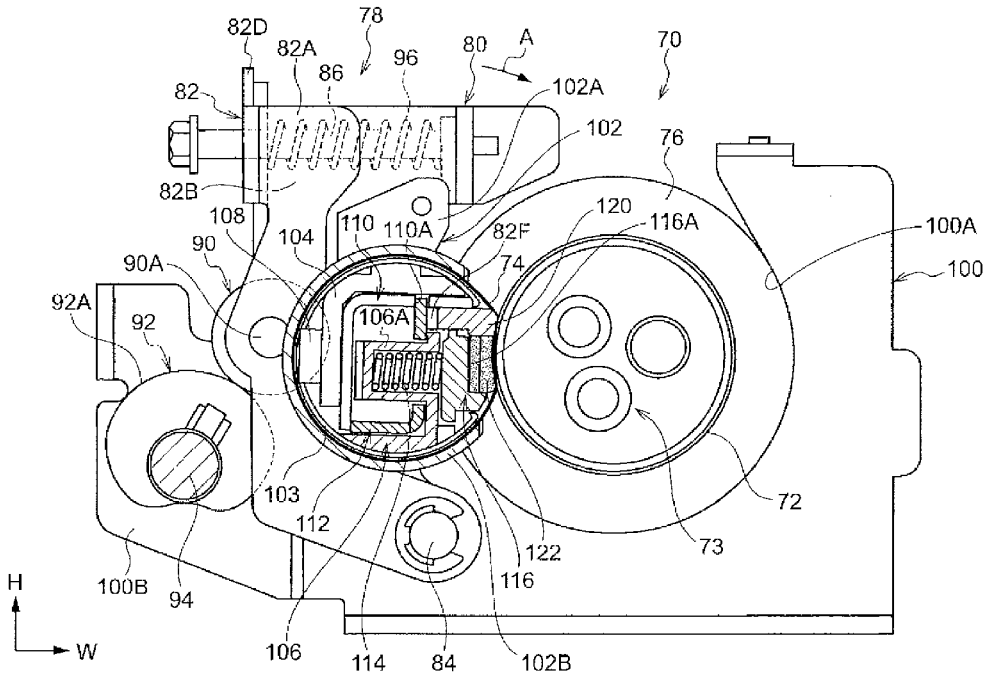
FIG. 5 is a sectional view illustrating a first state in which the fixing belt is pressed against the heating roll by a pad member and a block member which are used in the fixing device illustrated in FIG. 3.

The fixing belt 74 has a shape of an endless belt, and the release layer including the fluororesin is provided on the outer circumferential surface of a thin cylindrical base material made of a synthetic resin, such as a polyimide resin or a polyamide-imide resin, as necessary. As illustrated in FIG. 5, in order to press the outer circumferential surface of the fixing belt 74 against the outer circumferential surface of the heating roll 72, a block member 120 which is an example of a first member and a pad member 122 which is an example of a second member, are provided inside the fixing belt 74. The fixing belt 74 is configured to perform pressurizing by the heating roll 72 nipping the recording paper P (not illustrated), and the toner image on the recording paper P is fixed in the contact portion (nip portion) at which the outer circumferential surface of the heating roll 72 and the outer circumferential surface of the fixing belt 74 is in contact with each other. The configuration of the inside of the fixing belt 74 will be described later.

The support member 76 supports both end portions of the heating roll 72 to be rotatable via a bearing which is not illustrated. The support member 76 is supported by a bracket 100 in which an arc-like recessed portion 100A to which the support member 76 is fitted is formed.

Figure 4:
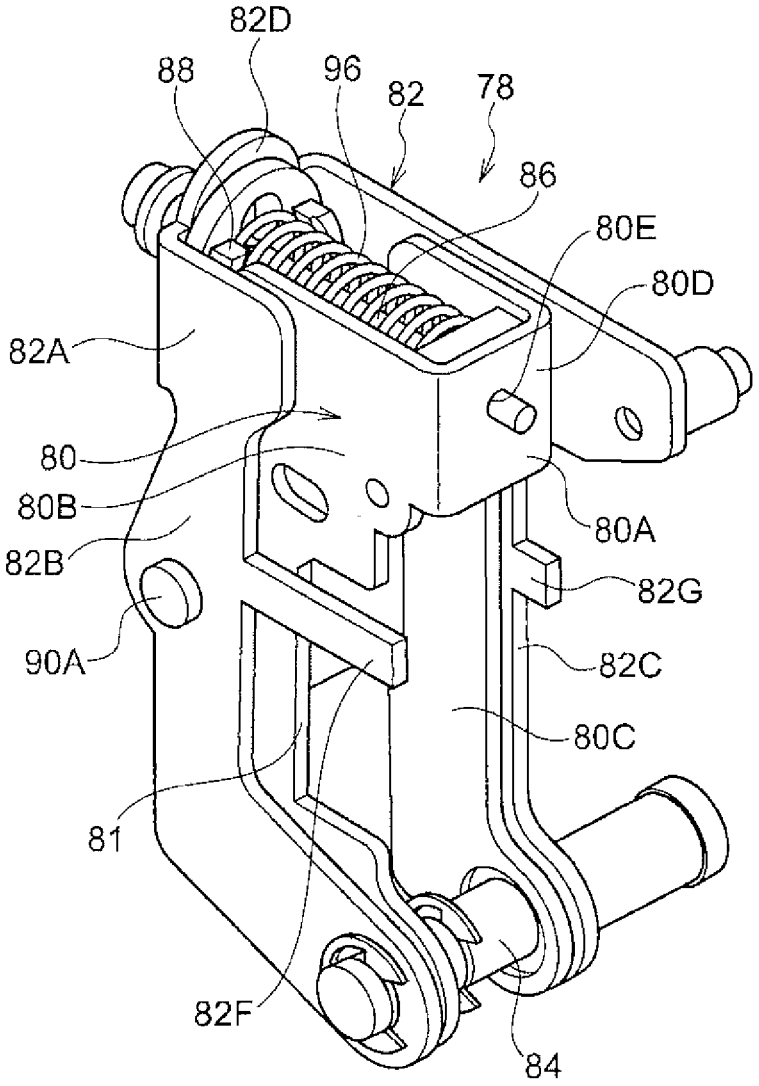
FIG. 4 is a perspective view illustrating a configuration of a child lever which supports a guide member of the fixing belt illustrated in FIG. 3, and a parent lever which supports the child lever to be movable.

As illustrated in FIGS. 2 to 4, the support unit 78 is provided with a guide member 102 which guides the fixing belt 74. Furthermore, the support unit 78 is provided with a child lever 80 and a parent lever 82. The child lever 80 is an example of a first support portion and supports the fixing belt 74 via the guide member 102. The parent lever 82 is an example of a second support portion and supports the child lever 80 to be relatively movable.

An upper portion 82A of the parent lever 82 in a plan view of the fixing device 70 is formed in a U shape, and is open toward the support member 76 side of the heating roll 72. An upper portion 80A of the child lever 80 in a plan view of the fixing device 70 has a U shape, and is open toward the side opposite to the support member 76. The width (width in the apparatus depth direction illustrated by the arrow D) of the child lever 80 is configured to be smaller than the width (width in the apparatus depth direction illustrated by the arrow D) of the parent lever 82, and the child lever 80 is inserted into the parent lever 82. In this state, the parent lever 82 and the child lever 80 relatively move.

More specifically, as illustrated in FIGS. 3 and 4, the child lever 80 is provided with an inner wall 80B disposed on the inner side (fixing belt 74 side) in the apparatus depth direction illustrated by the arrow D, and an outer wall 80C disposed to oppose the outer side (a side opposite to the fixing belt 74) of the inner wall 80B. On the inner wall 80B of the child lever 80, a recessed portion 81 which is recessed in the apparatus width direction (arrow W direction) is formed not to interfere with the fixing belt 74 (refer to FIG. 4). The parent lever 82 is provided with an inner wall 82B disposed on the inner side (fixing belt 74 side) in the apparatus depth direction illustrated by the arrow D, and an outer wall 82C disposed to oppose the outer side (a side opposite to the fixing belt 74) of the inner wall 82B. The inner wall 82B of the parent lever 82 is formed in an L shape not to interfere with the fixing belt 74 (refer to FIG. 4).

The inner wall 80B and the outer wall 80C of the child lever 80 are disposed between the inner wall 82B and the outer wall 82C of the parent lever 82, and a shaft portion 84 penetrates a through hole formed in a lower portion of the inner walls 82B and 80B and outer walls 80C and 82C. Accordingly, the child lever 80 and the parent lever 82 relatively move (in the exemplary embodiment, rotate) around the shaft portion 84. In other words, the child lever 80 and the parent lever 82 move independently from the support member 76.

In a wall 80D along the apparatus depth direction (D direction) of the upper portion 80A of the child lever 80, a hole portion 80E (refer to FIG. 4) is formed, and in a state where a pin member 86 is inserted into the hole portion 80E, a base end of the pin member 86 is fixed to the wall 80D (refer to FIGS. 4 and 5). The shaft direction of the pin member 86 is the direction intersecting the shaft direction of the shaft portion 84. In a wall 82D along the apparatus depth direction (D direction) of the upper portion 82A of the parent lever 82, a long hole 82E is formed (refer to FIG. 3). The long hole 82E is formed in the wall 82D so that a long diameter portion is in the apparatus height direction (H direction). The outer diameter of the shaft portion of the pin member 86 is configured to be smaller than a short diameter portion of the long hole 82E, and in a state where the tip end portion side of the pin member 86 penetrates the long hole 82E, the pin member 86 can move in the long hole 82E. In other words, the tip end portion of the pin member 86 is not fixed to the wall 82D of the parent lever 82, and is a free end.

A spring 96 is attached to the wall 82D of the parent lever 82. The spring 96 is an example of a second biasing member and biases the wall 80D of the child lever 80 to the support member 76 side of the heating roll 72. The spring 96 is disposed around the pin member 86, and in this state, one end of the spring 96 is fixed to the wall 82D of the parent lever 82 by an attaching tool 88 (refer to FIG. 4).

Figure 7:
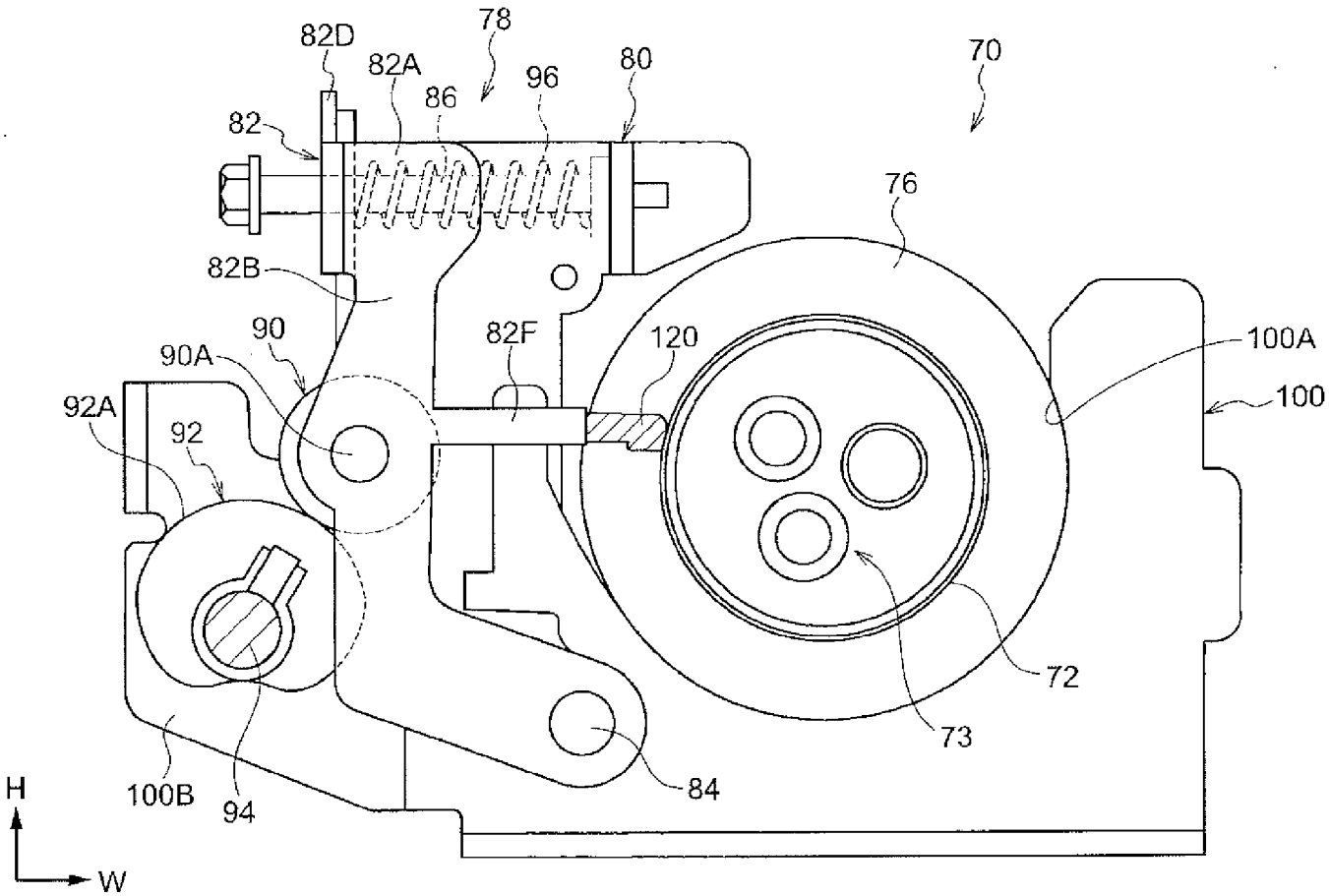

In addition, on an end surface on the guide member 102 side on the inner wall 82B and the outer wall 82C of the parent lever 82, one pair of projection portions 82F and 82G which protrude to the guide member 102 side are provided (refer to FIG. 4). The projection portions 82F and 82G have a plate shape, and the positions of the tip ends of the projection portions 82F and 82G are disposed to be parallel to the shaft direction of the fixing belt 74. As illustrated in FIG. 7, the block member 120 is fixed to the tip ends of the projection portions 82F and 82G of the parent lever 82 by adhesion or the like. More specifically, the parent lever 82 is provided as a left and right pair on both sides in the longitudinal direction of the fixing belt 74, and the block member 120 bridges between the tip ends of one pair of the left and right projection portions 82F and 82G of the parent lever 82 along the longitudinal direction of the fixing belt 74. Accordingly, the block member 120 is supported by the parent lever 82 in the fixing belt 74 (refer to FIG. 5). In the exemplary embodiment, the block member 120 is formed of a synthetic resin. In addition, in FIG. 7, in order to easily grasp the configuration, the fixing belt 74 is omitted.

As illustrated in FIGS. 2 and 3, in an intermediate portion of the parent lever 82 in the vertical direction, a roll member 90 is disposed, and a shaft portion 90A of the roll member 90 is supported to be rotatable by the inner wall 82B and the outer wall 82C. The roll members 90 are respectively provided to one left and right pair of the parent levers 82.

A cam 96 is supported by a wall 100B on the roll member 90 side in the apparatus width direction (arrow W direction) of the bracket 100, to be rotatable. The cam 92 is an example of a switching portion. The cams 92 are provided as a left and right pair on both sides of the fixing device 70 in the longitudinal direction, and the left and right pair of cams 92 are configured to be linked to each other by a rotating shaft 94 and to integrally rotate. In the cam 92, a radius of an outer circumferential surface 92A from the center portion of the rotating shaft 94 continuously changes in the circumferential direction, and the outer circumferential surface 92A of the cam 92 is in contact with the outer circumferential surface of the roll member 90. The cam 92 is driven to rotate by a motor (not illustrated) linked to the end portion of the rotating shaft 94 in the shaft direction.

As the position of the roll member 90 changes according to the rotation of the cam 92, the parent lever 82 relatively moves in the direction of approaching or being separated from the support member 76 of the heating roll 72 around the shaft portion 84.

The guide member 102 is disposed in both end portions of the fixing belt 74. As illustrated in FIGS. 3 and 5, the guide member 102 is provided with a main body portion 102A disposed along the vertical direction on the outer side of both end portions of the fixing belt 74 in the longitudinal direction, and an arc-like outer guide portion 102B formed along the outer circumferential surface of both end portions of the fixing belt 74 in the main body portion 102A (in FIG. 3, only one end portion of the fixing belt 74 is illustrated, and the other end portion of the fixing belt 74 is omitted). The guide member 102 is fixed to the child lever 80 by a fastening tool which is not illustrated. Accordingly, the guide member 102 rotates around the shaft portion 84 integrally with the child lever 80 with respect to the parent lever 82.

As illustrated in FIG. 5, on the inside of the fixing belt 74, an ark-like sliding sheet 103 which is disposed along the inner circumferential surface of the fixing belt 74 and allows the fixing belt 74 to slide, is provided. The sliding sheets 103 are respectively attached to a first attaching member 104 and a second attaching member 106 which are fixed to the main body portion 102A of the guide member 102. In addition, in FIG. 5, the first attaching member 104 is a section, but in order to easily grasp the configuration, hatching is omitted.

The sliding sheet 103, the first attaching member 104, and the second attaching member 106 are disposed along the longitudinal direction of the fixing belt 74. The first attaching member 104 is formed in an L shape in a sectional view, and a felt member 108 is fixed to one end portion of the first attaching member 104 by adhesion or the like to be in contact with the inner circumferential surface of the fixing belt 74. Lubricating oil is impregnated into the felt member 108. When the felt member 108 contacts with the inner circumferential surface of the fixing belt 74, the lubricating oil is supplied to the inner circumferential surface of the fixing belt 74.

On the inside of the fixing belt 74, a first holding portion 110 formed in an L shape in a sectional view is disposed along the first attaching member 104, and the first holding portion 110 is fixed to the first attaching member 104 and the main body portion 102A of the guide member 102. In addition, in FIG. 5, the first holding portion 110 is a section, but in order to easily grasp the configuration, hatching is omitted. A hole portion 110A is formed in one end portion (end portion on the heating roll 72 side) of the first holding portion 110. In addition, on the inside of the fixing belt 74, a second holding portion 112 formed in an L shape in a sectional view is disposed to configure the first holding portion 110 and a rectangular frame body. One end portion of the second holding portion 112 is inserted into the hole portion 110A of the first holding portion 110, and the other end portion of the second holding portion 112 is in contact with the other end portion of the first holding portion 110. In this state, the second holding portion 112 is fixed to the first holding portion 110. A part of the second attaching member 106 is in contact with the outer side of the other end portion of the second holding portion 112, and the other end portion of the second holding portion 112 is fixed to the second attaching member 106.

In the second attaching member 106, an attaching portion 106A having a U shape in a sectional view is formed on the center portion side of the fixing belt 74, the attaching portion 106A is disposed to be open to the heating roll 72 side. In the attaching portion 106A, a spring 114 which is an example of a first biasing member is disposed, and one end portion of the spring 114 is fixed to a bottom surface of the attaching portion 106A. A holding portion 116 having an L shape in a sectional view is attached to the other end portion of the spring 114. A recessed surface 116A is formed toward the heating roll 72 side in the holding portion 116, and the pad member 122 is fixed to the recessed surface 116A by adhesion or the like. Accordingly, the pad member 122 is biased to the heating roll 72 side by the spring 114 disposed in the attaching portion 106A of the second attaching member 106. The second attaching member 106 is fixed to the main body portion 102A of the guide member 102, and the pad member 122 is supported to approach and be separated from the main body portion 102A of the guide member 102. In the exemplary embodiment, the pad member 122 is formed of a foam resin, such as a silicone resin, and has a softer configuration than that of the block member 120. In addition, in the exemplary embodiment, the pad member 122 has a two-layered structure in which the foam resins having different forming ratios are layered, but the configuration of the pad member 122 can be changed, and for example, may have a single layer structure.

In the fixing device 70, the pad member 122 is disposed on the upstream side in the transport direction of the recording paper P (FIG. 1) which passes through the contact portion (nip portion) between the heating roll 72 and the fixing belt 74, and the block member 120 is disposed further on the downstream side in the transport direction of the recording paper P (FIG. 1) than the pad member 122. In other words, the pad member 122 is disposed on the upstream side in the transport direction of the recording paper P which passes through the contact portion (nip portion) between the heating roll 72 and the fixing belt 74 with respect to the block member 120. In the exemplary embodiment, in the contact portion between the heating roll 72 and the fixing belt 74, the transporting path of the recording paper P is disposed along the vertical direction, the pad member 122 is disposed on the lower side of the vertical direction, and the block member 120 is disposed on the upper side of the vertical direction. The pad member 122 and the block member 120 are disposed at a position at which the pad member 122 and the block member 120 are near or adjacent to each other.

In the fixing device 70, the child lever 80 is supported to be rotatable around the shaft portion 84 with respect to the parent lever 82, and the shaft portion 84 is disposed on the upstream side in the transport direction of the recording paper P with respect to the contact portion between the heating roll 72 and the fixing belt 74. Therefore, when the child lever 80 rotates around the shaft portion 84 with respect to the parent lever 82, the block member 120 which is positioned far from the shaft portion 84 is more largely displaced in the direction of approaching or being separated from the heating roll 72 than the pad member 122 which is positioned to be close to the shaft portion 84.

Figure 6:
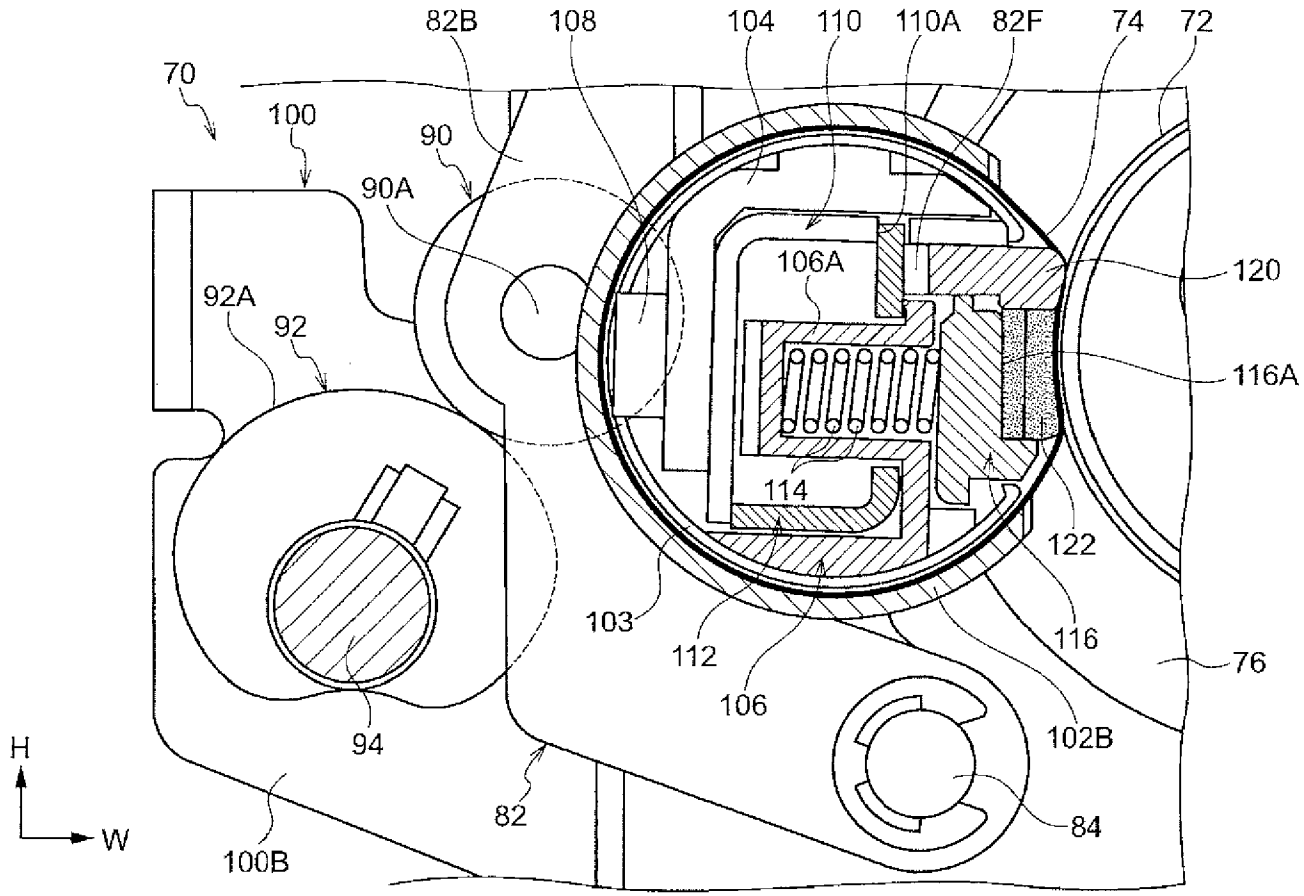
FIG. 6 is a sectional view illustrating a state where a part near the pad member, the block member, and the heating roll which are illustrated in FIG. 5 is enlarged.

In the fixing device 70, by the rotation of the cam 92, the parent lever 82 of the support unit 78 and the heating roll 72 (support member 76) are relatively moved in the direction of approaching or being separated from each other. As illustrated in FIGS. 5 and 6, when a part having a large radius of the outer circumferential surface 92A of the cam 92 comes into contact with the roll member 90, as the parent lever 82 rotates (rotates clockwise illustrated by the arrow A in FIG. 5) around the shaft portion 84, the parent lever 82 relatively moves in the direction of approaching the heating roll 72. In other words, in FIGS. 5 and 6, the parent lever 82 moves to a first position that is close to heating roll 72.

Figure 8:
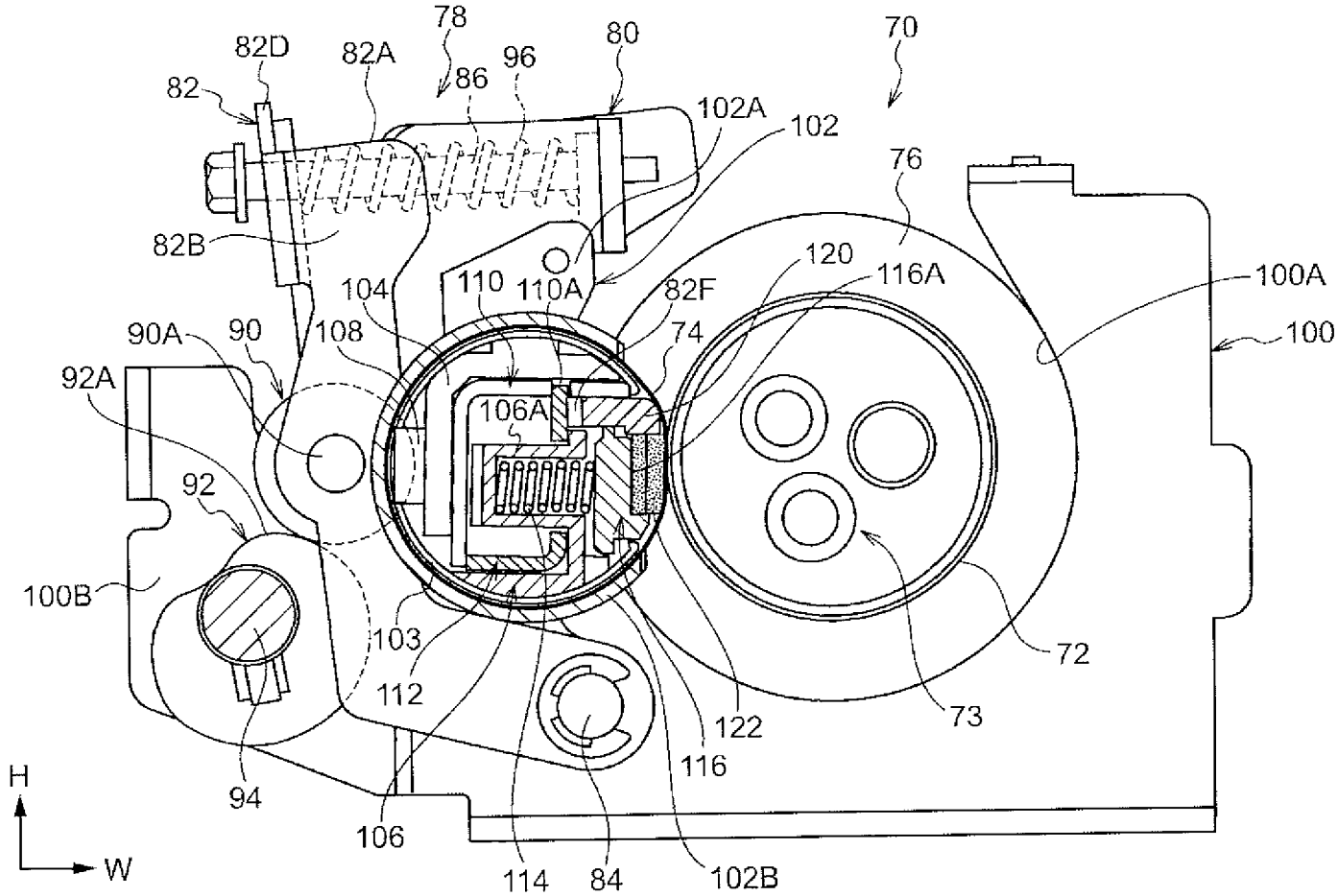
FIG. 8 is a sectional view illustrating a second state where the fixing belt is pressed against the heating roll only by the pad member among the pad member and the block member which are used in the fixing device illustrated in FIG. 3.
Figure 9:
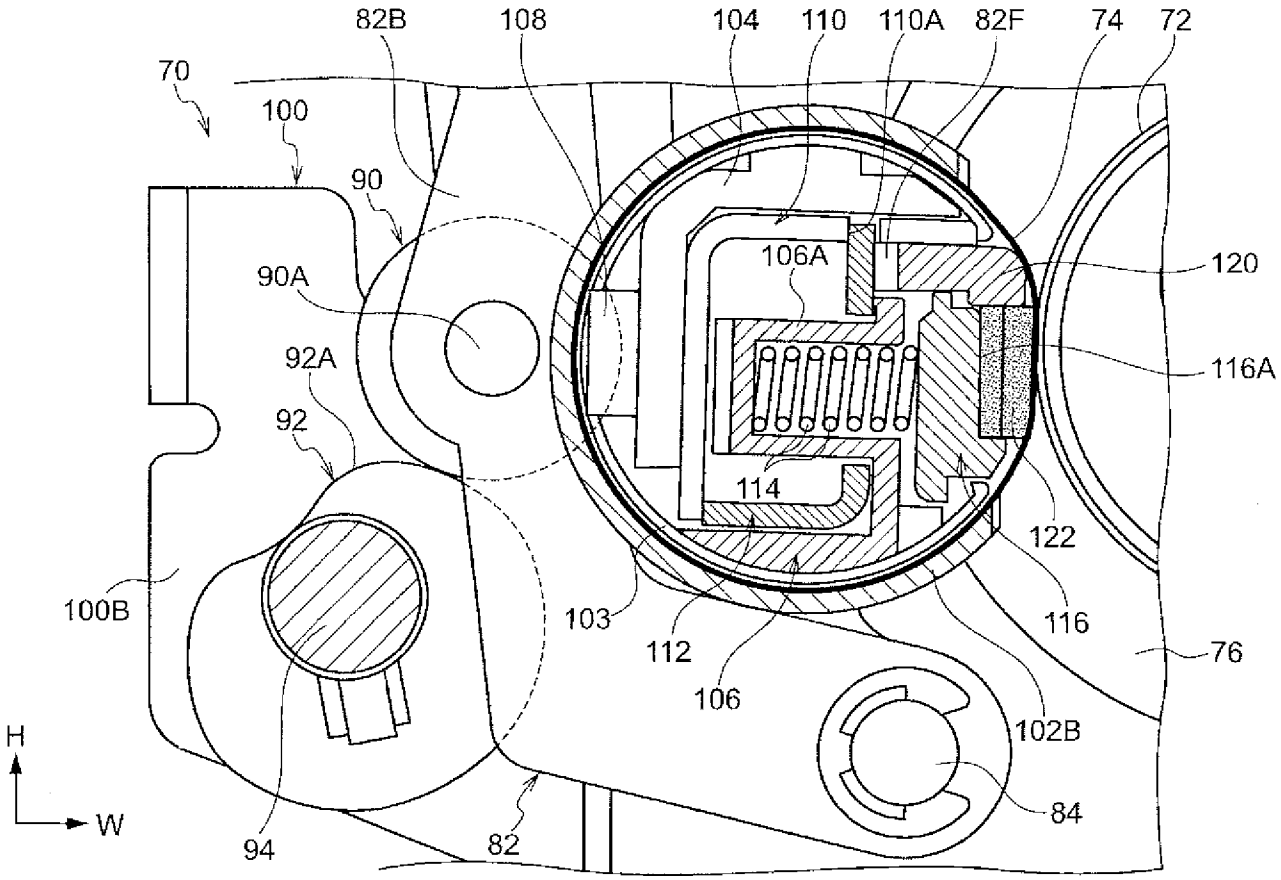
FIG. 9 is a sectional view illustrating a state where a part near the pad member, the block member, and the heating roll which are illustrated in FIG. 8 is enlarged.

In addition, as illustrated in FIGS. 8 and 9, when a part having a smaller radius of the outer circumferential surface 92A than the radius of the outer circumferential surface 92A of the first position (refer to FIG. 5) of the cam 92 comes into contact with the roll member 90, as the parent lever 82 rotates around the shaft portion 84, the parent lever 82 relatively moves in the direction of being separated from the heating roll 72. In other words, in FIGS. 8 and 9, the parent lever 82 moves to a second position which is separated from the heating roll 72.

The cam 92 is configured so as to switch between a first state and a second state by moving the parent lever 82 of the support unit 78 between the first position and the second position. In the first state, the fixing belt 74 is pressed against the heating roll 72 by the block member 120 and the pad member 122 (refer to FIGS. 5 and 6). In the second state, the fixing belt 74 is pressed against the heating roll 72 only by the pad member 122 (refer to FIGS. 8 and 9).

Here, the switching of latch by the cam 92 will be described in more detail. As illustrated in FIGS. 5 and 6, when the part having a large radius of the outer circumferential surface 92A of the cam 92 comes into contact with the roll member 90, a full latch mode is achieved, and the state of the full latch mode becomes the first state. In the first state, the parent lever 82 moves to the first position that is close to the heating roll 72, and the child lever 80 moves via the spring 96 with respect to the parent lever 82. In other words, the child lever 80 moves in the direction of approaching the heating roll 72 by a biasing force of the spring 96 of the upper portion 82A of the parent lever 82. In addition, as illustrated in FIG. 7, the block member 120 is fixed to the tip ends of the projection portions 82F and 82G of the parent lever 82, and the block member 120 moves to the heating roll 72 side. In the first state, the fixing belt 74 is pressed against the heating roll 72 by the block member 120 and the pad member 122 (refer to FIGS. 5 and 6).

Figure 11:
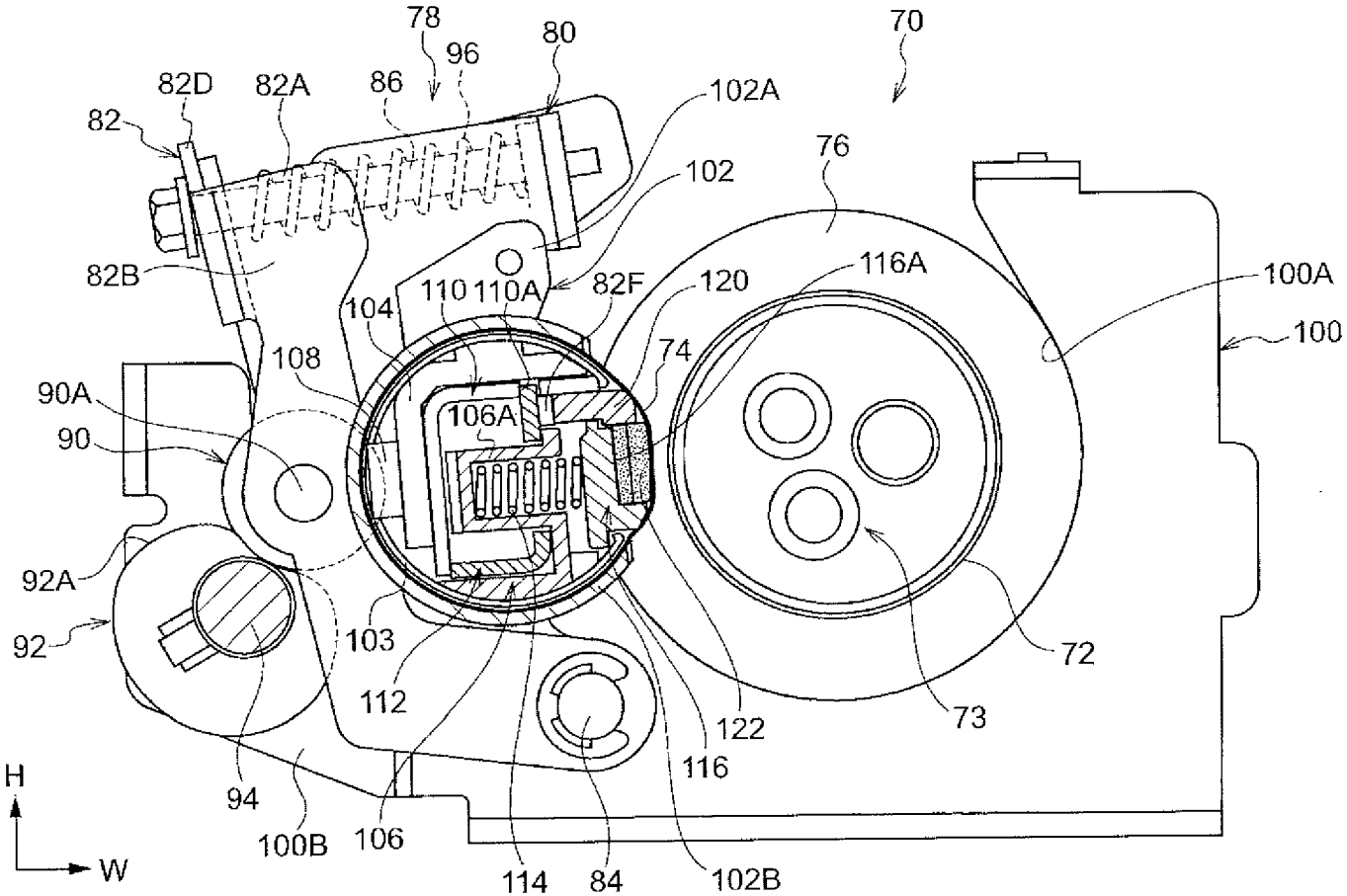
FIG. 11 is a sectional view illustrating a state where the fixing belt used in the fixing device illustrated in FIG. 3 is separated from the heating roll.
Figure 12:
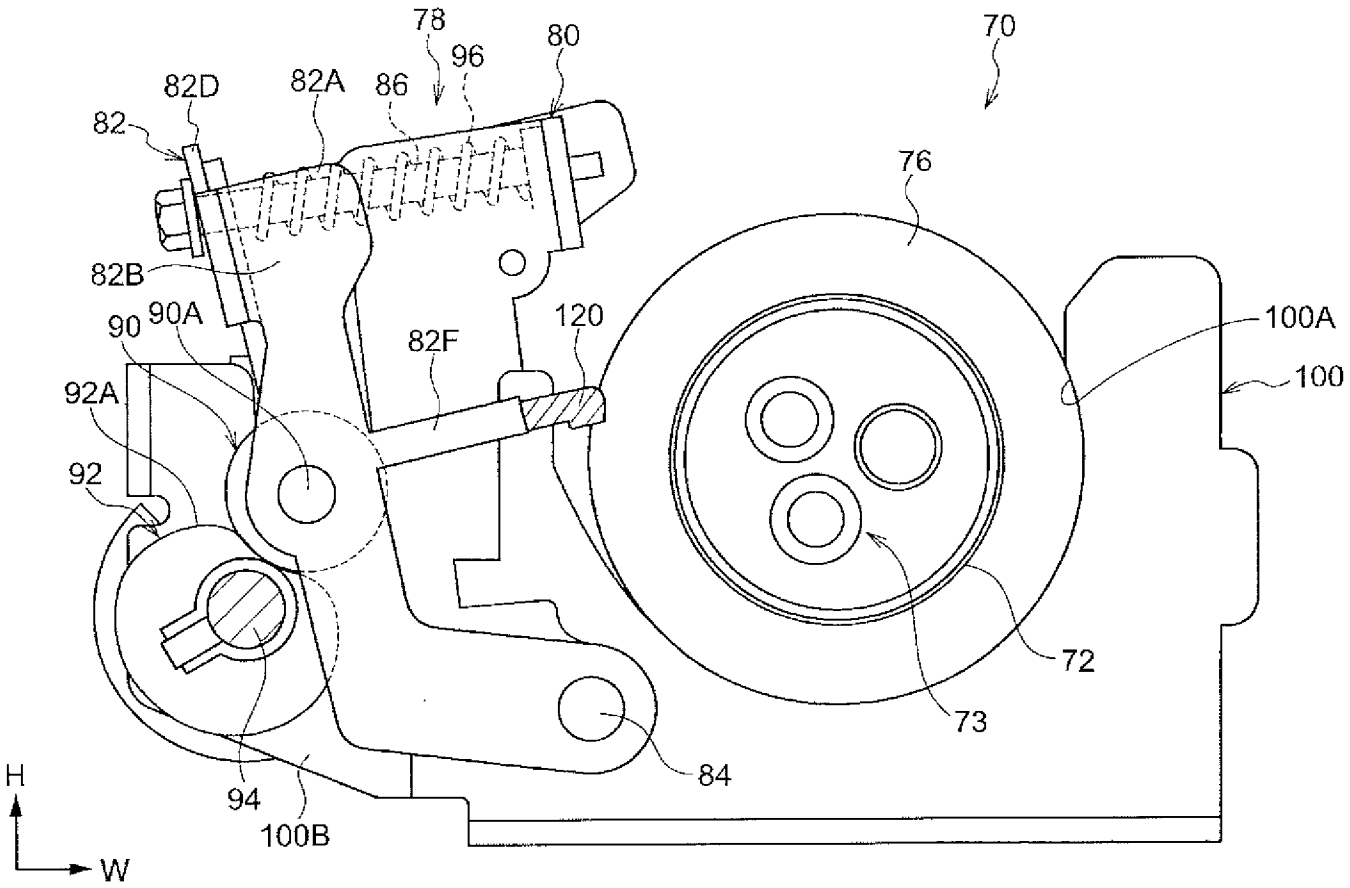

As illustrated in FIG. 11, when the part having the smallest radius of the outer circumferential surface 92A of the cam 92 comes into contact with the roll member 90, a latch release mode is achieved. In the latch release mode, as the parent lever 82 rotates around the shaft portion 84, the parent lever 82 relatively moves in the direction of being separated from the heating roll 72. In other words, the parent lever 82 moves to a third position which is the most separated from the heating roll 72. The child lever 80 is biased to the heating roll 72 side by the spring 96 of the upper portion 82A of the parent lever 82, the child lever 80 moves to a position at which the tip end portion (head portion) of the pin member 86 comes into contact with the wall 82D of the parent lever 82. In this state, the block member 120 and the pad member 122 are separated from the heating roll 72.

As illustrated in FIGS. 8 and 9, when a part (a part having a smaller radius than the radius of the first state and a larger radius than the radius of the latch release mode) at which the radius of the outer circumferential surface 92A of the cam 92 is set to be an intermediate dimension comes into contact with the roll member 90, a half latch mode is achieved, and a state of the half latch mode becomes the second state. In the second state, the parent lever 82 moves to the second position (a position that is closer to the heating roll 72 than the third position) which is more separated from the heating roll 72 than the first position. The child lever 80 is biased to the heating roll 72 side by the spring 96 of the upper portion 82A of the parent lever 82, and the child lever 80 stops at a position at which a load of the spring 96, a load of the spring 114, and a pressing force of the block member 120 are balanced with respect to the parent lever 82. In the second state, the fixing belt 74 is pressed against the heating roll 72 only by the pad member 122 among the block member 120 and the pad member 122.

In the fixing device 70, as the fixing belt 74 is pressurized to the heating roll 72 only by the pad member 122 in the second state, the length of the spring 114 and a stroke by which the pad member 122 moves are set.

In the image forming apparatus 10 provided with the fixing device 70, an operation of the motor which rotates the cam 92 is controlled by the controller 22.

The fixing device 70 is configured so that in the first state, the pressing load to the heating roll 72 by the block member 120 and the pad member 122 is switched between the high load and the low load by changing the radius of the outer circumferential surface 92A of the cam 92. In other words, in the first state, the pressing load increases (high load) at the part having a large radius of the outer circumferential surface 92A of the cam 92, and the pressing load decreases (low load) at the part having a smaller radius of the high load of the outer circumferential surface 92A of the cam 92 than that of the part. In addition, in the fixing device 70, in the second state, by changing the radius of the outer circumferential surface 92A of the cam 92, the pressing load to the heating roll 72 by the pad member 122 is configured to change to the high load and the low load. In other words, in the second state, the pressing load increases (high load) at the part (a part having a smaller radius than that of the first state) having a large radius of the outer circumferential surface 92A of the cam 92, the pressing load decreases (low load) at the part having a smaller radius of the outer circumferential surface 92A of the cam 92 than that of the part of the high load of the second state.

In accordance with the type of the recording paper P which passes through the contact portion (nip portion) between the heating roll 72 and the fixing belt 74, the cam 92 is configured to switch the first state and the second state. In the exemplary embodiment, the type of the recording paper P is detected by a sensor which is not illustrated, but the type of the recording paper P may be manually input. For example, when a thin paper (for example, a case of being less than 60 g/m2(GSN)) is used as the recording paper P, the cam 92 is switched to the high load in the first state, and when a normal paper (for example, a case of being from 60 g/m2(GSN) to 120 g/m2(GSN)) is used as the recording paper P, the cam 92 is switched to the low load in the first state. In addition, for example, when a thick paper (for example, a case of being greater than 170 g/m2(GSN)) is used as the recording paper P, the cam 92 is switched to the high load in the second state, and when an envelope (a case where of a double paper structure) is used as the recording paper P, the cam 92 is switched to the low load in the second state. In addition, the type of the recording paper P and the switching of the cam 92 are not limited to the above-described configuration, and can be changed.

Next, actions and effects of the exemplary embodiment will be described.

As illustrated in FIGS. 5 and 6, in the fixing device 70, when the part having a large radius of the outer circumferential surface 92A of the cam 92 comes into contact with the roll member 90, the full latch mode is achieved, and the first state is achieved. As the parent lever 82 rotates around the shaft portion 84 by the cam 92, the parent lever 82 moves to the first position that is close to the heating roll 72. In the upper portion 80A of the parent lever 82, the spring 96 which biases the child lever 80 to the heating roll 72 side is provided, and the child lever 80 moves in the direction of approaching the heating roll 72 by the spring 96. At this time, at the position at which the load of the spring 96, the load of the spring 114, and the pressing force of the block member 120 are balanced, the child lever 80 stops with respect to the parent lever 82.

As illustrated in FIG. 7, when the block member 120 is fixed to the tip ends of the projection portions 82F and 82G of the parent lever 82, and the parent lever 82 moves to the first position, the block member 120 moves to the heating roll 72 side. Accordingly, the fixing belt 74 is pressed against the heating roll 72 by the block member 120 supported by the parent lever 82.

In addition, the pad member 122 is biased to the heating roll 72 side by the spring 114 disposed in the second attaching member 106 of the guide member 102, and the guide member 102 rotates integrally with the child fever 80. Accordingly, the fixing belt 74 is pressed against the heating roll 72 by the pad member 122. Therefore, in the first state, the fixing belt 74 is pressed to the heating roll 72 by the block member 120 and the pad member 122. In other words, a part at which the fixing belt 74 is pressed against the heating roll 72 by the block member 120 and the pad member 122 becomes the contact portion (nip portion), and as the recording paper P passes through the contact portion, the toner image is fixed onto the recording paper P.

In addition, the fixing device 70 is configured so that in the first state, the pressing load to the heating roll 72 by the block member 120 and the pad member 122 is switched between the high load and the low load by changing the radius of the outer circumferential surface 92A of the cam 92.

As illustrated in FIG. 11, when the part (the part having a smaller radius than that of the first state and the second state) having the smallest radius of the outer circumferential surface 92A of the cam 92 comes into contact with the roll member 90, the latch release mode is achieved. As the parent lever 82 rotates around the shaft portion 84 by the cam 92, the parent lever 82 moves to the third position which is the most separated from the heating roll 72. The child lever 80 is biased to the heating roll 72 side by the spring 96 of the upper portion 82A of the parent lever 82, and by the force of the spring 96, the child lever 80 moves to the position at which the tip end portion (head portion) of the pin member 86 comes into contact with the wall 82D (refer to FIG. 9) of the parent lever 82.

When the parent lever 82 moves to the third position which is the most separated from the heating roll 72, the block member 120 fixed to the projection portions 82F and 82G of the parent lever 82 is separated from the heating roll 72. In addition, the pad member 122 attached to the child lever 80 (that is, the second attaching member 106 of the guide member 102) via the spring 114 is also separated from the heating roll 72.

As illustrated in FIGS. 8 and 9, when the part (the part having a radius smaller than that of the first state and a radius larger than that of the latch release state) at which the dimension of the outer circumferential surface 92A of the cam 92 is set to be the intermediate dimension comes into contact with the roll member 90, the half latch mode is achieved, and the second state is achieved. As the parent lever 82 rotates around the shaft portion 84 by the cam 92, the parent lever 82 moves to the second position (a position that is closer to the heating roll 72 than the third position) which is more separated from the heating roll 72 than the first position. The child lever 80 is biased to the heating roll 72 side by the spring 96 of the upper portion 82A of the parent lever 82. In addition, the pad member 122 is biased to the heating roll 72 side by the spring 114 disposed in the second attaching member 106 of the guide member 102. At the position at which the load of the spring 96, the load of the spring 114, and the pressing force of the block member 120 are balanced, the child lever 80 stops with respect to the parent lever 82.

Figure 10:
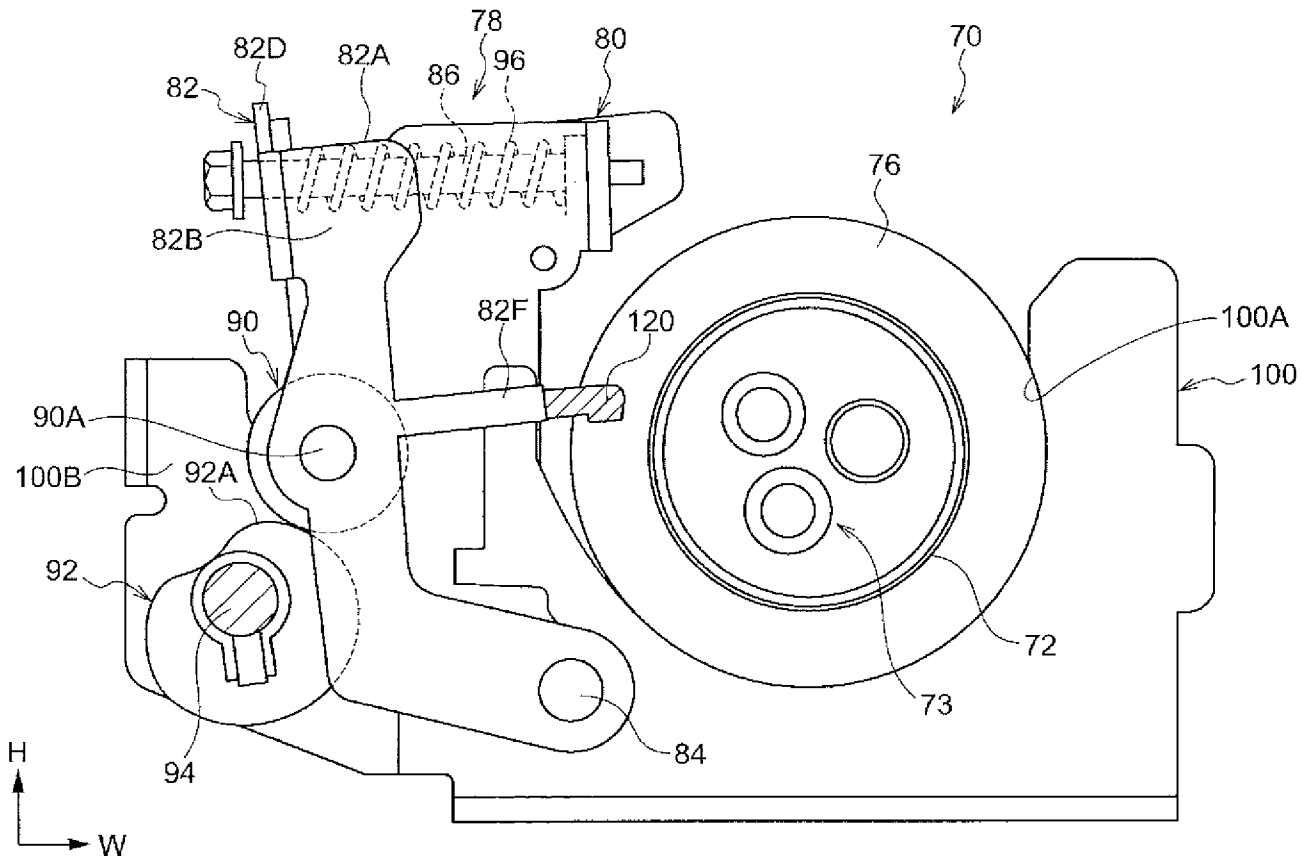

As illustrated in FIG. 10, the block member 120 is fixed to the tip ends of the projection portions 82F and 82G of the parent lever 82, and in the second state, the block member 120 moves to the side which is separated from the heating roll 72.

In addition, as illustrated in FIGS. 8 and 9, the pad member 122 is biased to the heating roll 72 side by the spring 114 provided in the child lever 80 (that is, the second attaching member 106 of the guide member 102), and the fixing belt 74 is pressed against the heating roll 72 by the pad member 122. Therefore, in the second state, the fixing belt 74 is pressed against the heating roll 72 only by the pad member 122 among the block member 120 and the pad member 122. In other words, the part at which the fixing belt 74 is pressed against the heating roll 72 only by the pad member 122 becomes the contact portion (nip portion), and as the recording paper P passes through the contact portion, the toner image on the recording paper P is fixed.

In addition, in the fixing device 70, in the second state, by changing the radius of the outer circumferential surface 92A of the cam 92, the pressing load to the heating roll 72 by the pad member 122 is changed to the high load and the low load.

The earn 92 switches four types of modes, such as the high load and the low load in the first state, and the high load and the low load in the second state, in accordance with the type of the recording paper P which passes through the contact portion (nip portion) between the heating roll 72 and the fixing belt 74.

In the fixing device 70, compared to a configuration in which the pad member is supported by the child lever and the block member is supported by the parent lever is not provided, the pressure to the heating roll 72 of the fixing belt 74 by the pad member 122 and the block member 120, and the pressure to the heating roll 72 of the fixing belt 74 only by the pad member 122, are switched by a short stroke of the parent lever 82.

In addition, according to the image forming apparatus 10 provided with the fixing device 70, compared to a configuration in which the switching portion which switches the first state and the second state is not provided, the load is switched to the appropriate fixing load in accordance with the type of the recording paper P which passes through the contact portion between the heating roll 72 and the fixing belt 74.

Figure 13:
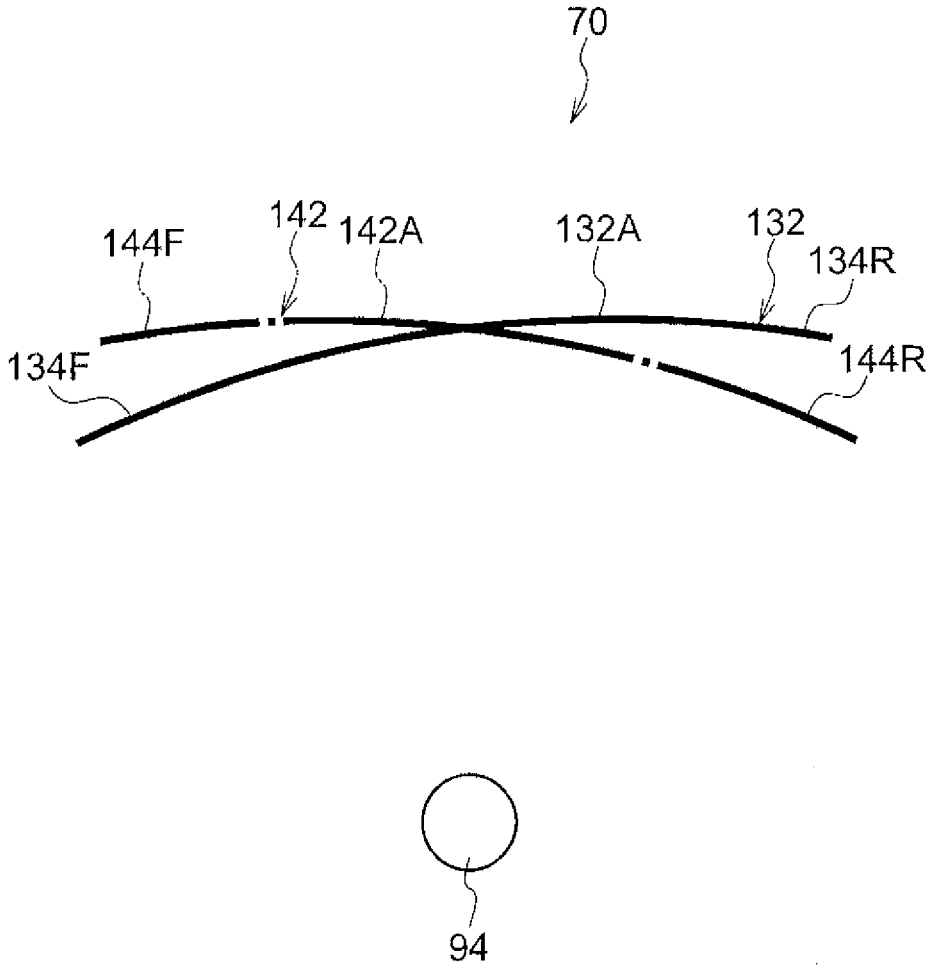
FIG. 13 is a schematic view of a modification example of a cam in a fixing device according to a first exemplary embodiment.

In FIG. 13, a modification example of the cam which is used in the fixing device 70 of the first exemplary embodiment is illustrated in a schematic configuration view.

As illustrated in FIG. 13, in the fixing device 70, instead of the cams 92 and 92 which are disposed in both end portions in the longitudinal direction of the fixing device 70 illustrated in FIG. 2, cams 132 and 142 which are an example of the switching portion disposed in both end portions in the longitudinal direction of the fixing device 70 are provided. The cam 142 is disposed on a front side (D side) in the longitudinal direction of the fixing device 70, and the cam 132 is disposed on a rear side (−D side) in the longitudinal direction of the fixing device 70. In the cam 132 and the earn 142, phases of outer circumferential surfaces 132A and 142A are changed in the longitudinal direction of the fixing device 70. More specifically, in the first state, the phase of the outer circumferential surface 132A of the cam 142 at the position at which the recording paper P passes through the contact portion between the heating roll 72 (refer to FIG. 5) and the fixing belt 74 (refer to FIG. 5), and the phase of the outer circumferential surface 132A of the cam 132, are changed. In other words, in the first state, by changing the phases of the outer circumferential surface 142A of the cam 142 on the front side (D side) and the phase of the outer circumferential surface 132A of the cam 132 on the rear side (−D side), a bite amount by which the block member 120 bites into the heating roll 72 via the fixing belt 74 is adjusted in the longitudinal direction of the fixing device 70.

In the example illustrated in FIG. 13, on an inlet side of the contact portion between the heating roll 72 (refer to FIG. 5) and the fixing belt 74 (refer to FIG. 5), by making the radius of the outer circumferential surface 142A (region 144F) of the cam 142 on the front side greater than the radius of the outer circumferential surface 132A (region 134F) of the cam 132 on the rear side, the bite amount by which the block member 120 bites into the heating roll 72 via the fixing belt 74 on the front side in the longitudinal direction of the fixing device 70, is adjusted to be greater than that on the rear side. In addition, on an exit side of the contact portion between the heating roll 72 (refer to FIG. 5) and the fixing belt 74 (refer to FIG. 5), by making the radius of the outer circumferential surface 142A (region 144R) of the cam 142 on the front side smaller than the radius of the outer circumferential surface 132A (region 134R) of the cam 132 on the rear side, the bite amount by which the block member 120 bites into the heating roll 72 via the fixing belt 74 on the rear side in the longitudinal direction of the fixing device 70, is adjusted to be greater than that on the front side.

In addition, the phase of the outer circumferential surface 142A of the cam 142 on the front side (D side), and the phase of the outer circumferential surface 132A of the cam 132 on the rear side (−D side), are not limited to the configuration illustrated in FIG. 13, and may be changed. For example, the cam 142 on the front side (D side) and the cam 132 on the rear side (−D side) may be reversed to each other, and two cams having a shape different from that of FIG. 13 may be respectively provided.

In the fixing device 70, compared to a case where a configuration of changing the phase of the cam in the longitudinal direction and adjusting the interference amount is not provided, the bite amount by which the block member 120 bites into the heating roll 72 via the fixing belt 74 in the longitudinal direction is adjusted.

Next, by using FIGS. 14 to 16, the fixing device according to the second exemplary embodiment of the invention will be described. In addition, configuration elements which are the same as those of the above-described first exemplary embodiment will be given the same reference numerals, and the description thereof will be omitted.

Figure 14:
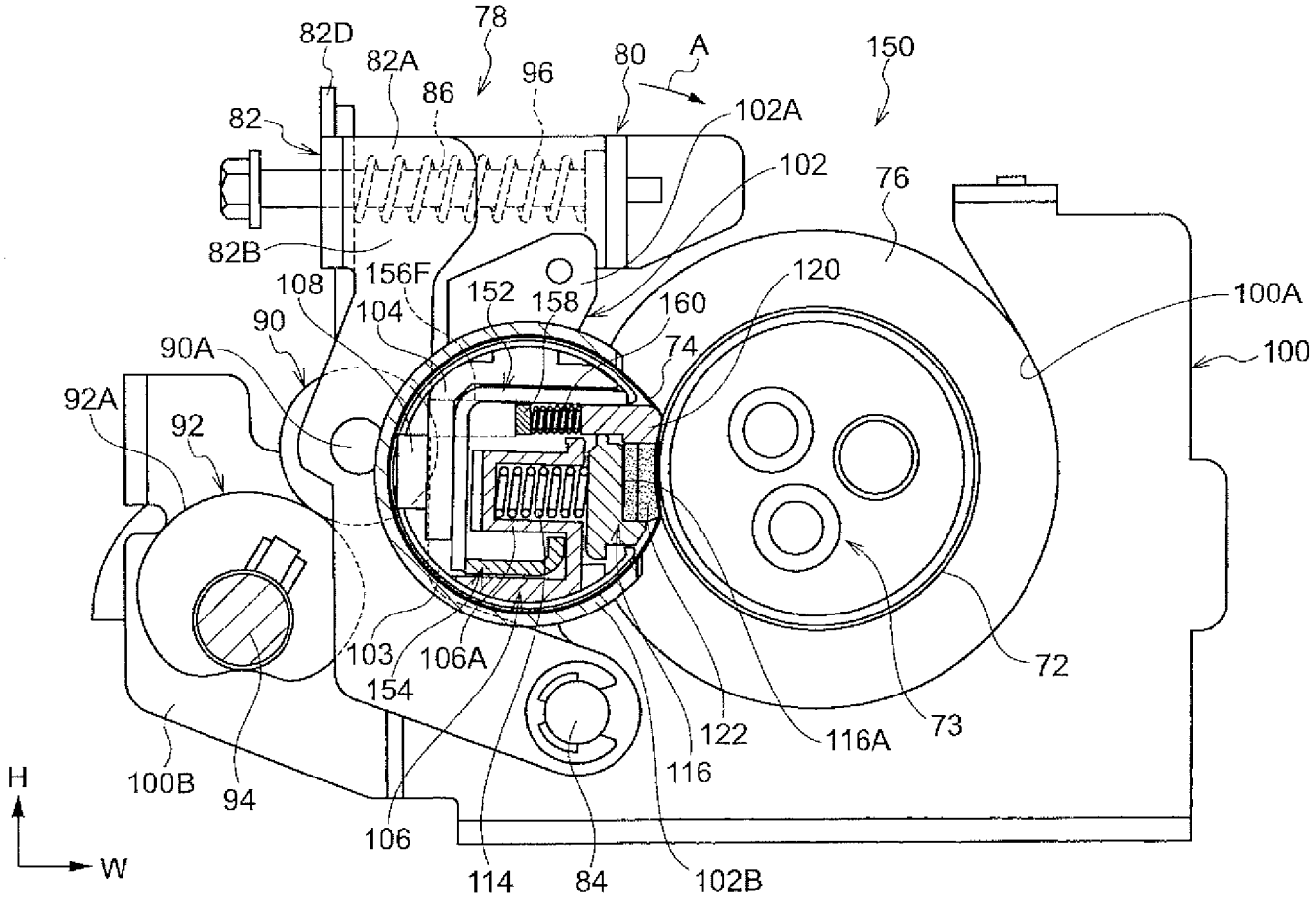
FIG. 14 is a sectional view illustrating a fixing device according to a second exemplary embodiment and illustrating the first state where the fixing belt is pressed against the heating roll by the pad member and the block member.

As illustrated in FIG. 14, in a fixing device 150, on the inside of the fixing belt 74, the second attaching member 106 is provided in a first holding portion 152 and a second holding portion 154 which are fixed to the main body portion 102A of the guide member 102. The first holding portion 152 is formed in an L shape in a sectional view, is disposed along the first attaching member 104, and is fixed to the first attaching member 104. The L-shaped second holding portion 154 is fixed to the first holding portion 152, and the second attaching member 106 is fixed to the second holding portion 154. In addition, in FIG. 14, the first holding portion 152 is a section, and in order to easily grasp the configuration, hatching is omitted.

On the inner wall 80B and the outer wall 80C of the parent lever 82 (not illustrated), a projection portion 156F (the projection portion on the outer side is not illustrated) which protrudes to the guide member 102 side is provided, and at the tip end of the projection portion 156F, a plate shaped attaching portion 158 is provided along the longitudinal direction of the fixing belt 74. One end portion of the spring 160 which is an example of a third biasing member is fixed to the attaching portion 158, and the block member 120 is fixed to the other end portion of the spring 160. Accordingly, the block member 120 is biased to the heating roll 72 side by the spring 160 provided in the parent lever 82.

In the fixing device 150, as illustrated in FIG. 14, when the part having a large radius of the outer circumferential surface 92A of the cam 92 comes into contact with the roll member 90, the full latch mode is achieved, and the first state is achieved. As the parent lever 82 rotates around the shaft portion 84 by the cam 92, the parent lever 82 moves to the first position that is close to the heating roll 72. In the first state, the block member 120 is biased to the heating roll 72 side by the spring 160 provided in the parent lever 82, and the fixing belt 74 is pressed against the heating roll 72 by the block member 120. In addition, the pad member 122 is biased to the heating roll 72 side by the spring 114 supported by the guide member 102 which rotates integrally with the child lever 80, and the fixing belt 74 is pressed against the heating roll 72 by the pad member 122. Therefore, in the first state, the fixing belt 74 is pressed to the heating roll 72 by the block member 120 and the pad member 122.

Figure 16:
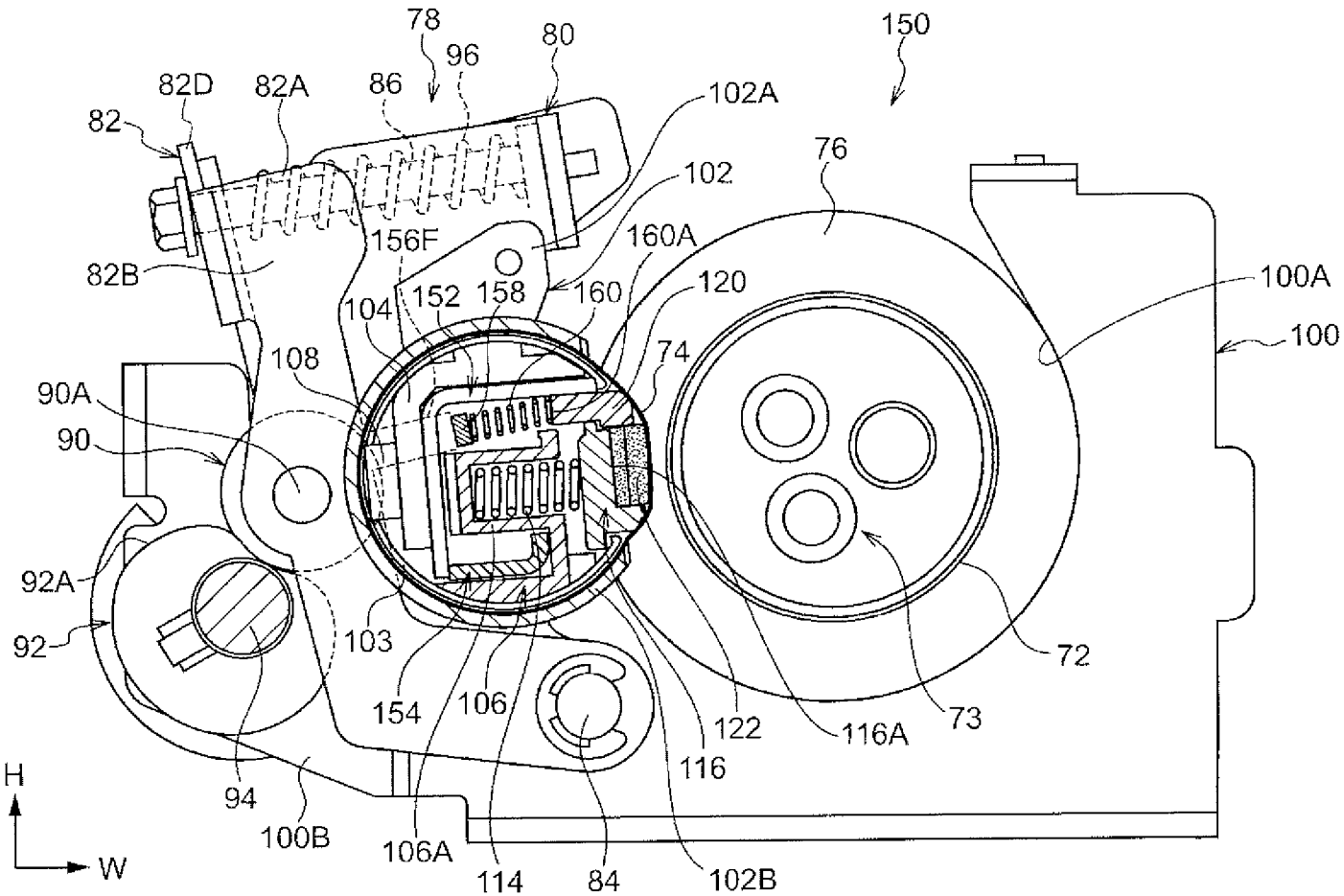
FIG. 16 is a sectional view illustrating a state where the fixing belt of the fixing device illustrated in FIG. 14 is separated from the heating roll.

As illustrated in FIG. 16, when the part having the smallest radius of the outer circumferential surface 92A of the cam 92 comes into contact with the roll member 90, the latch release mode is achieved. In a latch release state, as the parent lever 82 rotates around the shaft portion 84, the parent lever 82 moves to the third position which is the most separated from the heating roll 72, and the block member 120 and the pad member 122 are separated from the heating roll 72.

Figure 15:
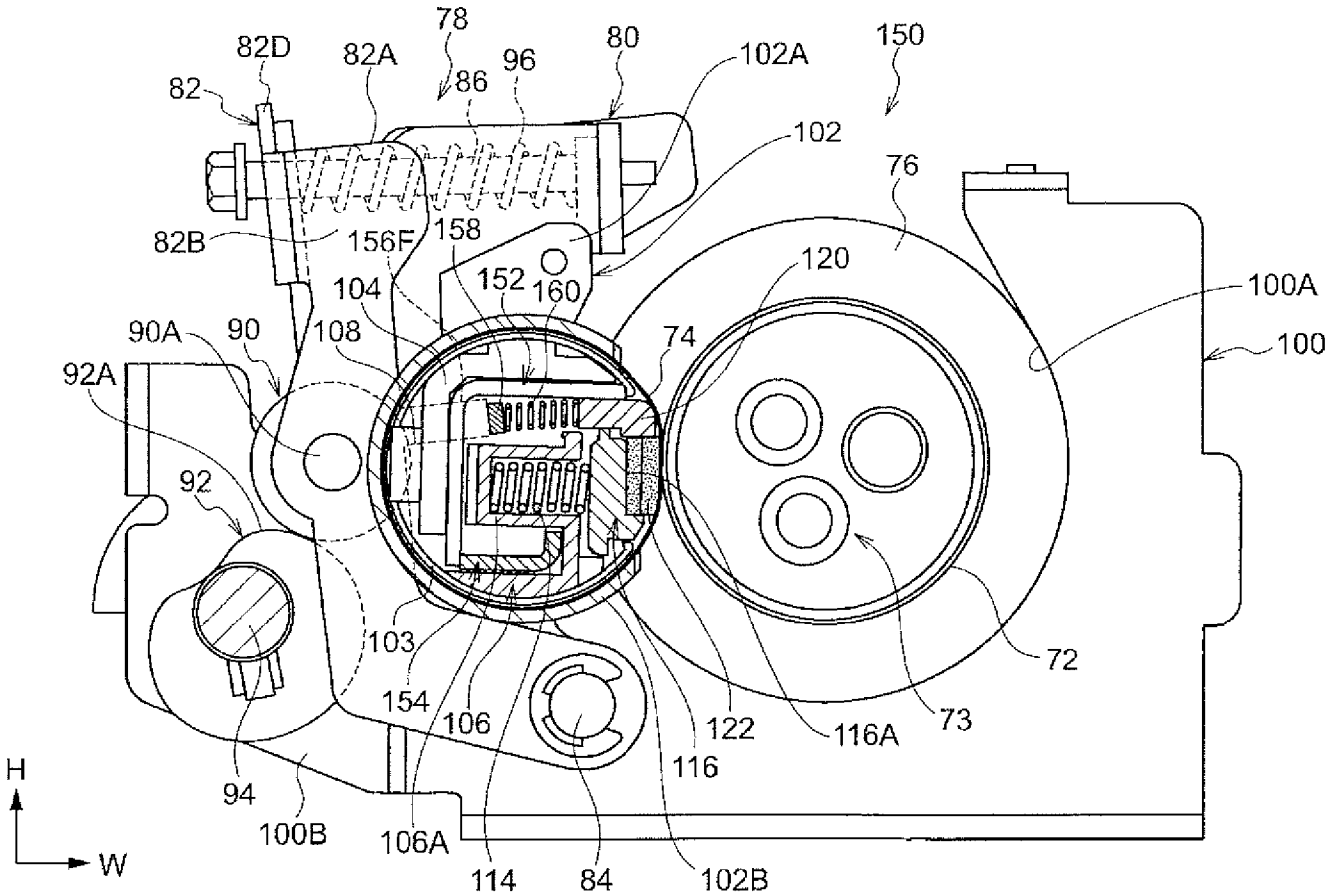
FIG. 15 is a sectional view illustrating the second state where the fixing belt is pressed against the heating roll only by the pad member among the pad member and the block member of the fixing device illustrated in FIG. 14.

As illustrated in FIG. 15, when the part (the part having a radius smaller than that of the first state and a radius larger than that of the latch release state) at which the radius of the outer circumferential surface 92A of the cam 92 is set to be the intermediate dimension comes into contact with the roll member 90, the half latch mode is achieved, and the second state is achieved. As the parent lever 82 rotates around the shaft portion 84 by the cam 92, the parent lever 82 moves to the second position (a position that is closer to the heating roll 72 than the third position) which is more separated from the heating roll 72 than the first position. In the second state, the block member 120 supported by the parent lever 82 via the spring 160 is separated from the heating roll 72.

The pad member 122 is biased to the heating roll 72 side by the spring 114 supported by the guide member 102 that rotates integrally with the child lever 80, and the fixing belt 74 is pressed against the heating roll 72 by the pad member 122. Therefore, in the second state, the fixing belt 74 is pressed against the heating roll 72 only by the pad member 122 among the block member 120 and the pad member 122.

In the fixing device 150, the spring 160 which biases the block member 120 to the heating roll 72 side is provided in the parent lever 82. Therefore, compared to a configuration in which the spring 160 is not provided, unevenness (unevenness of the load of the fixing belt 74 in the longitudinal direction and unevenness of the load on the upstream side and on the downstream side of the contact portion) of the load by which the fixing belt 74 is pressed against the heating roll 72 by the block member 120, is prevented.

Next, by using FIG. 17, the fixing device according to the third exemplary embodiment of the invention will be described. In addition, configuration elements which are the same as those of the above-described first and second exemplary embodiments will be given the same reference numerals, and the description thereof will be omitted.

Figure 17:
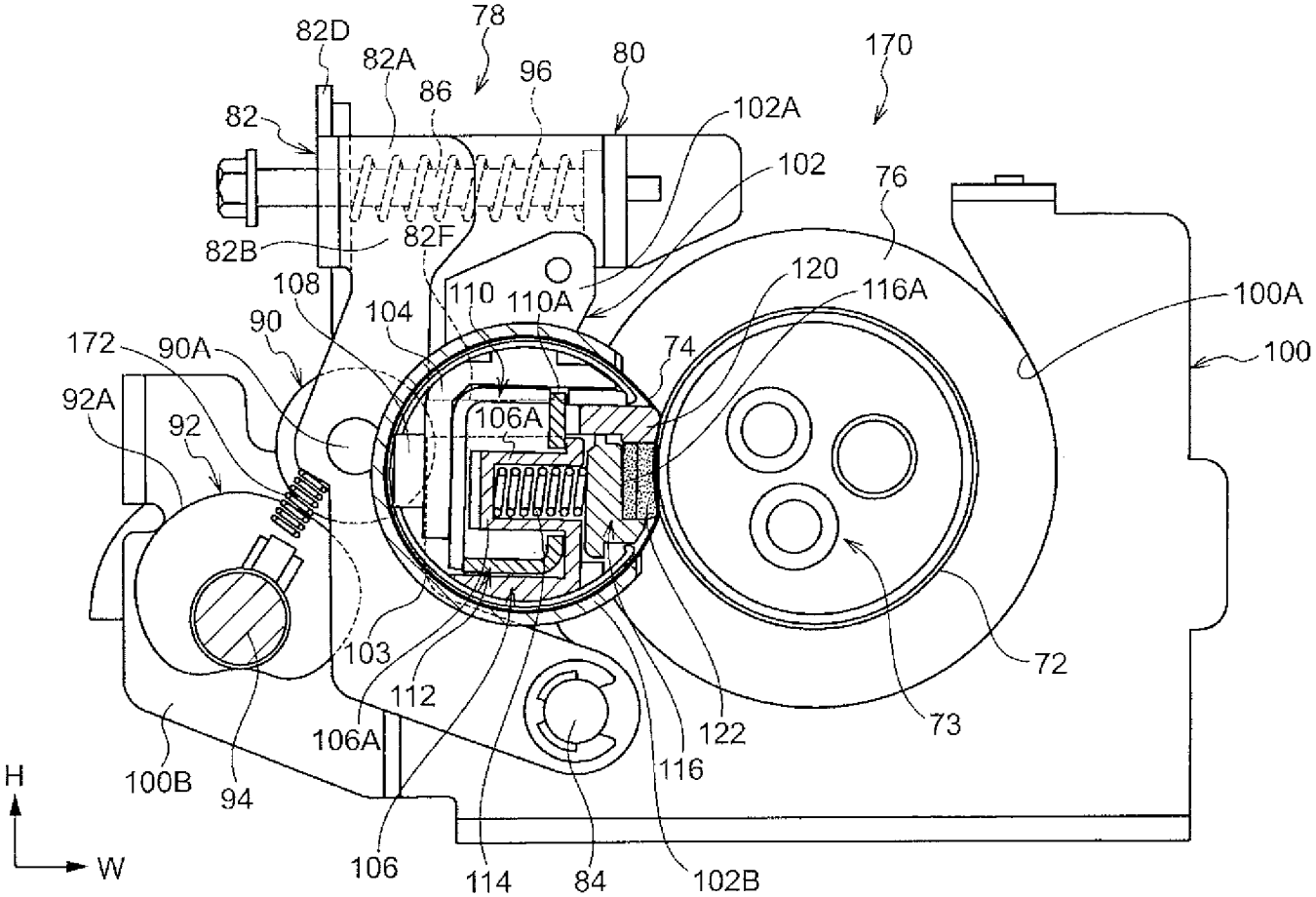
FIG. 17 is a sectional view illustrating a fixing device according to a third exemplary embodiment and illustrates the first state where the fixing belt is pressed against the heating roll by the pad member and the block member.

As illustrated in FIG. 17, in the fixing device 170, a spring 172 which is an example of the third biasing member is provided between the cam 92 and the roll member 90, in the cam 92. By providing the spring 172 between the cam 92 and the roll member 90, in a state where a gap is provided between the outer circumferential surface 92A of the cam 92 and the circumferential surface of the roll member 90, the outer circumferential surface 92A of the cam 92 and the circumferential surface of the roll member 90 oppose to be close to each other. In addition, the block member 120 is fixed to the tip end of the projection portion 82F of the parent lever 82. Accordingly, the block member 120 is biased to the heating roll 72 side by the spring 172 provided between the cam 92 and the roll member 90.

In the fixing device 170, as illustrated in FIG. 17, as the parent lever 82 rotates around the shaft portion 84 by the cam 92 in the first state, the parent lever 82 moves to the first position that is close the heating roll 72. In the first state, as the block member 120 is biased to the heating roll 72 side by the spring 172 between the cam 92 and the roll member 90, the fixing belt 74 is pressed against the heating roll 72 by the block member 120.

In addition, the pad member 122 is biased to the heating roll 72 side by the spring 114 supported by the guide member 102 which rotates integrally with the child lever 80, and the fixing belt 74 is pressed against the heating roll 72 by the pad member 122. Therefore, in the first state, the fixing belt 74 is pressed to the heating roll 72 by the block member 120 and the pad member 122.

In the fixing device 170, compared to a configuration in which the spring 172 is not provided, unevenness (unevenness of the load of the fixing belt 74 in the longitudinal direction and unevenness of the load on the upstream side and on the downstream side of the contact portion) of the load by which the fixing belt 74 is pressed against the heating roll 72 by the block member 120 is prevented.

In addition, in the first to third exemplary embodiments, the cam 92 is used as a switching portion, but the invention is not limited thereto. For example, a configuration in which a switching portion, such as a cylinder, an actuator, and a lack and pinion, is used, may be employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first support portion that supports an endless belt, and relatively moves with respect to a rotating body to press the endless belt against the rotating body;

a second support portion that supports the first support portion to be relatively movable;

a first member that is supported in the endless belt by the second support portion;

a second member that is supported in the endless belt to be capable of approaching and being separated from the first support portion;

a first biasing member that is provided in the first support portion, and biases the second member to a rotating body side;

a second biasing member that is provided in the second support portion, and biases the first support portion to the rotating body side; and a switching portion that switches between a first state and a second state, wherein in the first state, the endless belt is pressed against the rotating body by the first member and the second member by moving the second support portion in a direction of approaching the rotating body, and in the second state, the endless belt is pressed against the rotating body only by the second member among the first member and the second member by moving the second support portion in a direction of being separated from the rotating body.

2. The fixing device according to claim 1, wherein a third biasing member that biases the first member to the rotating body side is provided in the switching portion.

3. The fixing device according to claim 1, wherein a third biasing member that biases the first member to the rotating body side is provided in the second support portion.

4. The fixing device according to claim 1, wherein the switching portion includes a cam that relatively moves the rotating body and the second support portion in the direction of approaching or being separated from each other, and wherein the cam is configured to adjust a bite amount by which the first member bites into the rotating body via the endless belt in a longitudinal direction, by changing a phase of the cam.

5. The fixing device according to claim 2, wherein the switching portion includes a cam that relatively moves the rotating body and the second support portion in the direction of approaching or being separated from each other, and wherein the cam is configured to adjust a bite amount by which the first member bites into the rotating body via the endless belt in a longitudinal direction, by changing a phase of the cam.

6. The fixing device according to claim 3, wherein the switching portion includes a cam that relatively moves the rotating body and the second support portion in the direction of approaching or being separated from each other, and wherein the cam is configured to adjust a bite amount by which the first member bites into the rotating body via the endless belt in a longitudinal direction, by changing a phase of the cam.

7. An image forming apparatus comprising:

the fixing device according to claim 1, wherein the switching portion switches between the first state and the second state in accordance with a type of a recording medium which passes a contact portion between the rotating body and the endless belt.

8. An image forming apparatus comprising:

the fixing device according to claim 2, wherein the switching portion switches between the first state and the second state in accordance with a type of a recording medium which passes a contact portion between the rotating body and the endless belt.

9. An image forming apparatus comprising:

the fixing device according to claim 3, wherein the switching portion switches between the first state and the second state in accordance with a type of a recording medium which passes a contact portion between the rotating body and the endless belt.

10. An image forming apparatus comprising:

the fixing device according to claim 4, wherein the switching portion switches between the first state and the second state in accordance with a type of a recording medium which passes a contact portion between the rotating body and the endless belt.

11. An image forming apparatus comprising:

the fixing device according to claim 5, wherein the switching portion switches between the first state and the second state in accordance with a type of a recording medium which passes a contact portion between the rotating body and the endless belt.

12. An image forming apparatus comprising:

the fixing device according to claim 6, wherein the switching portion switches between the first state and the second state in accordance with a type of a recording medium which passes a contact portion between the rotating body and the endless belt.

* * * * *